US006444090B1

(12) United States Patent
Wolf et al.

(10) Patent No.: US 6,444,090 B1
(45) Date of Patent: Sep. 3, 2002

(54) PROCESS AND DEVICE FOR SPRAYING A MOVING FIBROUS WEB

(75) Inventors: Robert Wolf, Herbrechtingen; Markus Oechsle, Bartholomae; Frank Wegehaupt, Böhmenkirch; Lothar Bendig, Pfullingen; Klaus Landvatter, Weinstadt; Reinhard Gaa, Metzingen, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/671,622

(22) Filed: Sep. 28, 2000

(30) Foreign Application Priority Data

Sep. 28, 1999 (DE) ..... 199 46 479

(51) Int. Cl.[7] ..... B05B 12/06; B05D 1/02

(52) U.S. Cl. ..... 162/135; 162/204; 162/265; 118/325; 427/424

(58) Field of Search ..... 162/110, 115, 162/124, 127, 128, 135, 136, 175, 183, 184, 186, 198, 199, 204, 252, 262, 265, 272, 275, 310, 308; 101/147, 148; 118/300, 325, 683, 684; 239/76, 89, 91; 427/421, 424

(56) References Cited

U.S. PATENT DOCUMENTS

| | | | | | |
|---|---|---|---|---|---|
| 3,590,775 | A | * | 7/1971 | Barr | 118/5 |
| 4,873,925 | A | | 10/1989 | Hultberg et al. | 101/147 |
| 4,957,060 | A | * | 9/1990 | Cann | 118/699 |
| 5,038,681 | A | | 8/1991 | Hultberg | 101/484 |
| 5,286,348 | A | * | 2/1994 | Perin | 162/262 |
| 5,673,622 | A | * | 10/1997 | Larsson | 101/147 |
| 5,792,317 | A | * | 8/1998 | Taylor et al. | 162/175 |
| 5,839,364 | A | * | 11/1998 | Niemiro et al. | 101/148 |

FOREIGN PATENT DOCUMENTS

| | | | |
|---|---|---|---|
| DE | 3811260 | 10/1989 | B06D/1/02 |
| DE | 4139671 | 6/1993 | F16K/27/02 |
| DE | 68924433 | 10/1995 | B41F/7/30 |
| DE | 4419446 | 11/1998 | F16K/31/06 |
| DE | 1980140 | 7/1999 | B05D/1/40 |

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

Process and apparatus for spraying a moving fibrous web with at least one jet. The process includes feeding a controlled volume flow of a spray agent to the at least one jet through at least one pulsing valve, and damping and reducing pulses occurring in the controlled volume flow of the spray agent. The apparatus includes at least one jet arranged to be fed with a controlled volume flow of a spray agent, at least one pulsing valve which feeds the controlled volume flow of the spray agent to said at least one jet, and at least one pulse damper arranged to damp or reduce pulses occurring in the controlled volume flow of the spray agent.

41 Claims, 3 Drawing Sheets

PROCESS AND DEVICE FOR SPRAYING A MOVING FIBROUS WEB

CROSS-REFERENCE TO RELATED APPLICATIONS

The present application claims priority under 35 U.S.C. § 119 of German Patent Application No. 199 46 479.0, filed on Sep. 28, 1999, the disclosure of which is expressly incorporated by reference herein in its entirety.

BACKGROUND OF THE INVENTION

1. Field of the Invention

The invention relates to a process for spraying a moving fibrous web, in particular a paper or a cardboard web, by at least one jet, in which a preferably controlled volume flow of the corresponding spray is fed to the jet. It further relates to a device for spraying a moving fibrous web, in particular, a paper or cardboard web with at least one jet, to which a preferably controlled volume flow of the corresponding spray agent can be fed.

2. Discussion of Background Information

Spray arrangements are used in the production, refinement, and processing of fibrous webs in order to purposefully influence certain web characteristics. These characteristics can be, for instance, the moisture content, the surface moisture, the surface coating, and/or the like. Alternately or additionally the inoculation of additional materials is possible.

At present the following two general concepts are used in applications in which a variable volume flow is sprayed (compare, e.g., the lateral moisture profiling by jet moisturizers in paper production):

1. Parallel Connection of Valves (Binary Control of Volume Flow)

In such a parallel connection of valves with a binary control of volume flow several valves of different flow amounts are connected in parallel to form a valve block. Each valve can only be either open or closed. By opening separate valves with different volume flows various volume flow totals can be created by addition.

This control concept has the disadvantage that only a stepped volume flow characteristic can be created by addition. Another disadvantage is the large number of separate valves per jet and the resulting large demand for space, and the large expense of the valve block.

2. Sequential Arrangement of Jets (Binary Control of Volume Flow)

In such a sequential arrangement several jets of various flow amounts during spraying are arranged successively in the web travel direction. Each jet is controlled by a valve which can only be either opened or closed. By combining separate open valves different volume flow totals can be created by addition.

This control concept has the disadvantage that only a stepped volume flow characteristic can be created by addition. Another disadvantage is the large number of separate valves per jet and the resulting large expense of the combined spray unit.

At the present state of the art, proportional valves are rarely used in small volume flows since the control range is too narrow and the danger of clogging is too great. Additionally, these valves are very expensive. A pulsed moisturizing spray system is known from DE 689 24 433 T2 which is used to feed a moisturizing liquid to a roll in a printing press.

SUMMARY OF THE INVENTION

It is an aspect of the invention to create a process and a device of the above mentioned type in which the above mentioned disadvantages are removed.

An aspect relating to the process is attained according to the invention in feeding the volume flow of the spray agent to the jet via at least one pulsing valve in which pulses that occur in the volume flow of the spray agent are preferably damped or reduced. Here, the volume flow fed to the jet is preferably controlled by the pulsing valve.

Pulsing valves are preferably used in paper and cardboard machines, in particular jet moisturizers, coating units, starch spray devices, profiling devices etc. In general, they can be used for controlling volume flow of liquids in jets during spraying of fibrous moving webs, in particular in spray devices of paper and cardboard machines, in particular in jet moisturizers, surface coating devices, starch spray devices, profiling devices etc.

Preferably an armature valve is used and, in particular, a plate armature valve. Pulsing valves per se are described already in the publications DE 41 396 71 C2 and DE 44 194 46 C2.

In a preferred practical embodiment, pulses that occur in the volume flow of the spray agent are damped or reduced by at least one pulse damper prepositioned to the jet and/or by the use of a jet with an appropriately large spray width measured in web travel direction and/or by the use of a flexible inlet line to the jet.

Pulsing dampers or impulse dampers use the compressibility of gases to level pressure variations. The arrangement of the inlet line and the outlet line in a substantially larger closed gas volume, compared with the pipe diameter, enables the influx of the liquid until both cross-sections (inlet and outlet) are submerged in the liquid. The remaining gas volume is enclosed and is therefore compressed in accordance with the applied pressure. The pre-filling pressure of the gas is adjusted to the operating pressure. Rapidly occurring pressure changes (pulses) change the volume of the enclosed gases (mostly air). The energy transforming compression and expansion of the gas buffer smooths the occurring pulses.

In the flexible soft jet inlet line, which is used, in particular, in combination with a pulsing valve, the fact is used that the elasticity of such a flexible jet inlet line has a damping effect. The flexible jet inlet line can be formed by, e.g., a polyethylene hose, a polyurethane hose or a polyamide hose. It can, for example, be longer than about 3 m and preferably longer than about 5 m. An equivalent arrangement is preferably used in paper and cardboard machines, in particular, in jet moisturizers, coating devices, starch spray devices, molding devices etc.

Advantageously, a jet is used whose measured spray width in web travel direction is at least about 30% and preferably at least about 50% of the spray width measured crosswise to the web travel direction. In certain cases, it is advantageous when a fan jet is used as the jet. Here, for example, an elliptical fan jet can be used.

Such fan jets can, in particular, be used in combination with the mentioned pulse dampers and/or flexible jet inlet lines which ensure a sufficient damping of the pulses. Fan jets are characterized in that all streams impact the fibrous web at an almost identical angle in the web travel direction. The effectiveness of the moisturization depends on that angle. This has the advantage that the best angle can be adjusted for the maximal moisture effectiveness.

In a preferred practical embodiment a fan jet is used as the jet which sprays opposite to the web travel direction at an angle towards the fibrous web, with the angle being, in particular, smaller than about 80° and preferably smaller than about 70°. With this the effectiveness of the moisturization is increased accordingly and/or fogging is reduced. A corresponding fan jet can be used preferably at web travel speeds larger than, in particular, about 1200 m/min and preferably larger than about 1500 m/min. An appropriate arrangement is preferably used in paper and cardboard machines, in particular in jet moisturizers, coating devices, starch spray devices, molding devices etc.

In certain cases it can also be advantageous if a solid cone jet is used. The volume flow fed by such a pulsing valve is advantageously controlled by pulse-width modulation. Here, the pulsing valve is preferably activated with a constant frequency.

The process described is advantageously used in paper and cardboard machines and, in particular, in jet moisturizers, coating devices, starch spray devices, molding devices and/or the like.

The device according to the invention is characterized in that the volume flow of the spray agent of the jet is introduced via at least one pulsing valve, in which preferably devices are provided to dampen or reduce pulses occurring in the volume flow of the spray agent.

Therefore, based on the process according to the invention as well as the device according to the invention, in particular, pulsing valves as, for example, armature valves and, in particular, plate armature valves, i.e., valves with a plate armature, can be used in paper and cardboard machines. Here, in particular, the use of jet moisturizers, coating devices, starch spray devices, molding devices and/or the like is possible. The relevant pulsing valves can be provided, in particular, for controlling the volume flow of the related spray agent.

Therefore, the following advantages of such pulsing valves can also be used, in particular: (1) continuous control of an average volume flow between 0% and 100%; and (2) suitable also for smaller volume flows and liquid pressures due to the large control range only one valve and one jet per spray position necessary in machine cross-section.

The construction according to the invention prevents transmission of the pulses created by such valves into the spray liquid. The corresponding pulse dampers (or elastic inlet lines) can be used, in particular, in lines for liquids or suspensions in paper or cardboard machines. For example, at least one pulse damper can be used, in the related pipe between a jet and a valve of any kind, preferably a pulsing valve. The pulse dampers can be used, for example, in arrangements for spraying moving fibrous webs, in particular, in spray devices in paper and cardboard machines and, in particular, in jet moisturizers, coating devices, starch spray devices, profiling devices, and/or the like.

Among the advantages of these pulse dampers are: (1) pulses in the spray agent, that are created, in particular, by pulsing valves, are damped; and (2) variations of spray amount on a moving fibrous web are reduced accordingly.

Pulsing valves like, in particular, armature valves and preferably plate armature valves can be combined, in particular, for use in paper and cardboard machines with pulse dampers and/or flexible inlet lines. A unit can be formed, in particular, from a pulsing valve and a pulse damper and/or an elastic jet inlet line.

Pulsing valves, in particular armature valves and, preferably, plate armature valves can be combined with, besides pulse dampers and/or flexible inlet lines, also the related liquid spray jet. Such combinations can again be used, e.g., in devices for spraying moving fibrous webs, in particular, in spray devices in paper and cardboard machines and, in particular, in jet moisturizers, coating devices, starch spray devices, profiling devices and/or the like. Therefore, a unit can be created from a pulsing valve, a pulse damper and/or a flexible inlet line and a jet.

It is an advantage of such a unit of a pulse damper and/or a flexible inlet line, a valve and a jet that a pulsing valve, due to the pulse damping, can also be used for the spraying of moving webs.

Pulsing valves, such as in particular armature valves and preferably plate armature valves for the spraying of moving fibrous webs to be used, in particular, in spraying devices in paper and cardboard machines, in particular, in jet moisturizers, coating devices, starch spraying devices, profiling devices and/or the like can also be used, in particular, in combination with jets with a large spray width in web travel direction, in particular, larger than about 30% of the spray width lateral to the web travel direction, whereas in particular elliptical fan jets or solid cone jets can be used. Therefore, a unit can be formed, in particular, from a pulsing valve and a jet with a large spray width.

One of the advantages of the use of such jets in connection with pulsing valves is, among others, the fact that by the large spray width in the web travel direction a pulsing in the volume flow is reduced in the spray pattern. This is caused by a large spray width moisturizing a point on the moving web over a longer period of time. Thus, the variations in the volume flow are leveled at that point during this time frame.

Pulsing valves such as, in particular, armature valves and preferably plate armature valves can also be used in combination with at least one pulsation damper and/or a flexible inlet line and in combination with jets whose spray width is large in the web travel direction and is in particular larger than about 30% and preferably larger than about 50% of the spray width lateral to the web travel direction, whereas in particular elliptical fan jets or solid cone jets are used for spraying the moving fibrous webs. Again, they can be used, in particular, in spraying devices of paper or cardboard machines, in particular in jet moisturizers, coating devices, starch spraying devices, profiling devices and/or the like. Therefore, a pulsing valve can also be used, in particular, in combination with a pulsing damper and a jet with a large spray width.

As a result of the large spray width of the jet in the web travel direction and the use of at least one damper, moisture variations are largely eliminated by the spraying of the moving web, which, in particular, allows use for fast moving webs.

In particular, a process as well as a device for controlling the volume flow with at least one pulsing valve is created for liquid media, that controls volume flow at a jet or a group of jets and that can be used for spraying moving fibrous webs, in particular, in spray devices of paper or cardboard machines, whereas here, in particular, use in jet moisturizers, coating devices, starch spray devices, profiling devices and/or the like is also possible.

Pulsing valves per se create a pulsing volume flow which can be transmitted onto the spray pattern in spraying moving webs. The applied spray amount would therefore vary according to the pulsing in the web travel direction. Here, the amount of variation in the spray amount depends on the following factors: frequency of pulsing, web speed, spray width in web travel direction, number of jets in web travel direction, and damping of pulses. Due to the solution according to the invention undesired variations in the volume flow in pipes for liquids, caused, e.g., by natural oscillation of structural parts of machines, such as, in particular, pulsing valves in paper and cardboard machines, are damped.

With the use of one or more pulsing valves a continuous, i.e., steady and not staircase-like, formed volume flow characteristic is achieved over the entire control range. In contrast to the prior art, any volume flow can thus be set, which allows, e.g., a more precise response function in moisture profiling with jet moisturizers.

Due to the damper system according to the invention spraying with little pulsing is possible. This is, e.g., achieved by reducing the variations of liquids behind the pulsing valve directly in front of the jet by, in particular, at least about 50%, in particular, at least about 80% and, in particular, at least about 90%. Thus, pulses are reduced in the spray liquid which were created by oscillating machine parts such as a pump or a pulsing valve, which improves the homogeneity of the spray pattern in the web travel direction.

A homogeneous spraying of a moving fibrous web, such as in particular a paper web is possible, whose speed v can be greater than, e.g., about 500 m/min, in particular, greater than about 1000 m/min and, preferably, greater than about 1500 m/min. Variations in the volume flow with high frequencies can become obvious in the spray pattern by increasing web travel speeds.

Using fewer valves per jet, in particular, when using only one valve per jet, smaller construction dimensions can be achieved for the control unit in contrast to the prior art, in particular, in spray units in paper and cardboard machines, that may allow the integration of the valve directly into the spray beam.

As a result of the smaller number of valves and/or jets in contrast to the prior art, in particular, if only one valve is used per jet or only one jet per spray position lateral to the web travel direction, and/or more cost effective valves, spray units can be produced, in particular, in spray units in paper and cardboard machines, that require less maintenance and cost less.

As a spray agent, e.g., liquids come to mind, in particular, water, starch, inoculants, paints, and varnishes. The volume flow of each jet and/or valve could, for example, be in a range up to about 30 l/min, in particular, up to about 0.70 l/min and, preferably, up to about 0.20 l/min.

The device according to the invention is also characterized by a relatively long life. For instance, the use in largely continuous operation with more than about 70% operational time, in particular, with more than about 90% operational time is conceivable for a life of at least about 3 years, in particular at least 5 years.

The invention can be used, in particular, at a pressure of less than about 20 bar, in particular, less than about 2 bar and, preferably, less than about 1 bar. In particular, different jet types can be used. They include, in particular, one material jets, two material jets (liquid-gas, liquid-liquid), internally or externally mixing, various spray forms, in particular, fan jets and in particular solid cone jets. In particular, volume flows of a relation smaller than about 1:5, in particular, smaller than about 1:10 can be imagined.

The present invention is directed to a process for spraying a moving fibrous web with at least one jet. The process includes feeding a controlled volume flow of a spray agent to the at least one jet through at least one pulsing valve, and damping and reducing pulses occurring in the controlled volume flow of the spray agent.

In accordance with a feature of the invention, the fibrous web can be one of paper and cardboard.

According to another feature of the invention, the process can include controlling the controlled volume flow to the at least jet with the at least one pulsing valve.

The at least one pulsing valve can include at least one armature valve. The at least one pulsing valve may include at least one plate armature valve.

In accordance with another feature of the invention, the pulses occurring in the volume flow of the spray agent may be damped or reduced by at least one of: (a) at least one pulse damping member preceding the at least one jet, (b) at least one jet having an appropriately large spray width measured in the web travel direction, and (c) at least one flexible inlet line provided to the at least one jet.

According to still another feature of the present invention, the at least one jet has a spray width measured in the web travel direction which may be at least about 30% of the spray width measured lateral to the web travel direction. The spray width measured in web travel direction can be at least about 50% of the spray width measured lateral to the web travel direction.

According to a further feature of the present invention, the at least one jet may include at least one elliptical fan jet.

Moreover, the at least one jet may include at least one fan jet oriented to spray at an angle to the fibrous web smaller than about 80° and oriented opposite the web travel direction. The angle may be smaller than about 70°. An appropriately rated fan jet can be used at web speeds greater than 1200 m/min, and preferably an appropriately rated fan jet may be used at web speeds greater than 1500 m/min.

According to a still further feature of the instant invention, the at least one jet can include at least one solid cone jet.

The controlled volume flow fed through the at least one pulsing valve may be controlled by pulse width modulation. Further, the at least one pulsing valve can be actuated with a constant frequency.

According to still another feature of the invention, the process can be used in one of paper and cardboard machines.

Further, the process may be used in at least one of jet moisturizers, coating devices, starch spray devices, and profiling devices.

The present invention is directed to an apparatus for spraying a moving fibrous web that includes at least one jet arranged to be fed with a controlled volume flow of a spray agent, at least one pulsing valve which feeds the controlled volume flow of the spray agent to said at least one jet, and at least one pulse damper arranged to damp or reduce pulses occurring in the controlled volume flow of the spray agent.

According to a further feature of the instant invention, the fibrous web can be one of a paper and cardboard web.

In accordance with another feature of the invention, the at least one pulsing valve may be arranged to control the controlled volume flow fed to the at least one jet.

According to still another feature of the present invention, the at least one pulsing valve can include at least one armature valve.

In accordance with a further feature of the invention, the at least one pulsing valve may include at least one plate armature valve.

Moreover, the at least one pulse damper can include at least one of (a) at least one pulse damping member positioned to precede the at least one jet, (b) an appropriately large spray width of the at least one jet measured in the web travel direction, and (c) at least one flexible inlet line coupled to the at least one jet. Further, the at least one flexible inlet line provided to the jet may be formed by a hose comprising one of polyethylene, polyurethane, and polyamide hose. The at least one flexible inlet line provided to the at least one jet can have a length that is longer than about 3 m, and the length of the at least one flexible inlet line can be longer than about 5 m. The at least one pulsing valve and the at least one pulse damper may be arranged in a common unit. Still further, the unit can further include the at least one flexible inlet line and the at least one jet.

The at least one jet can be provided with a spray width measured in the web travel direction that is at least about 30% of the spray width measured lateral to the web travel direction. Further, the spray width measured in the web travel direction is at least about 50% of the spray width measured lateral to the web travel direction.

According to another feature of the invention, the at least one jet can include at least one elliptical fan jet.

The at least one jet may include at least one fan jet which sprays at an angle to the fibrous web smaller than about 80° and opposite the web travel direction. The angle can be smaller than about 70°.

In accordance with a further feature of the present invention, the at least one jet can include a solid cone jet.

The volume flow fed via the at least one pulsing valve may be controlled via pulse width modulation. The at least one pulsing valve may be actuated with constant frequency.

The apparatus can be utilized in one of paper and cardboard machines. Further, the apparatus can be utilized in at least one of jet moisturizers, coating devices, starch spray devices, and profiling devices.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
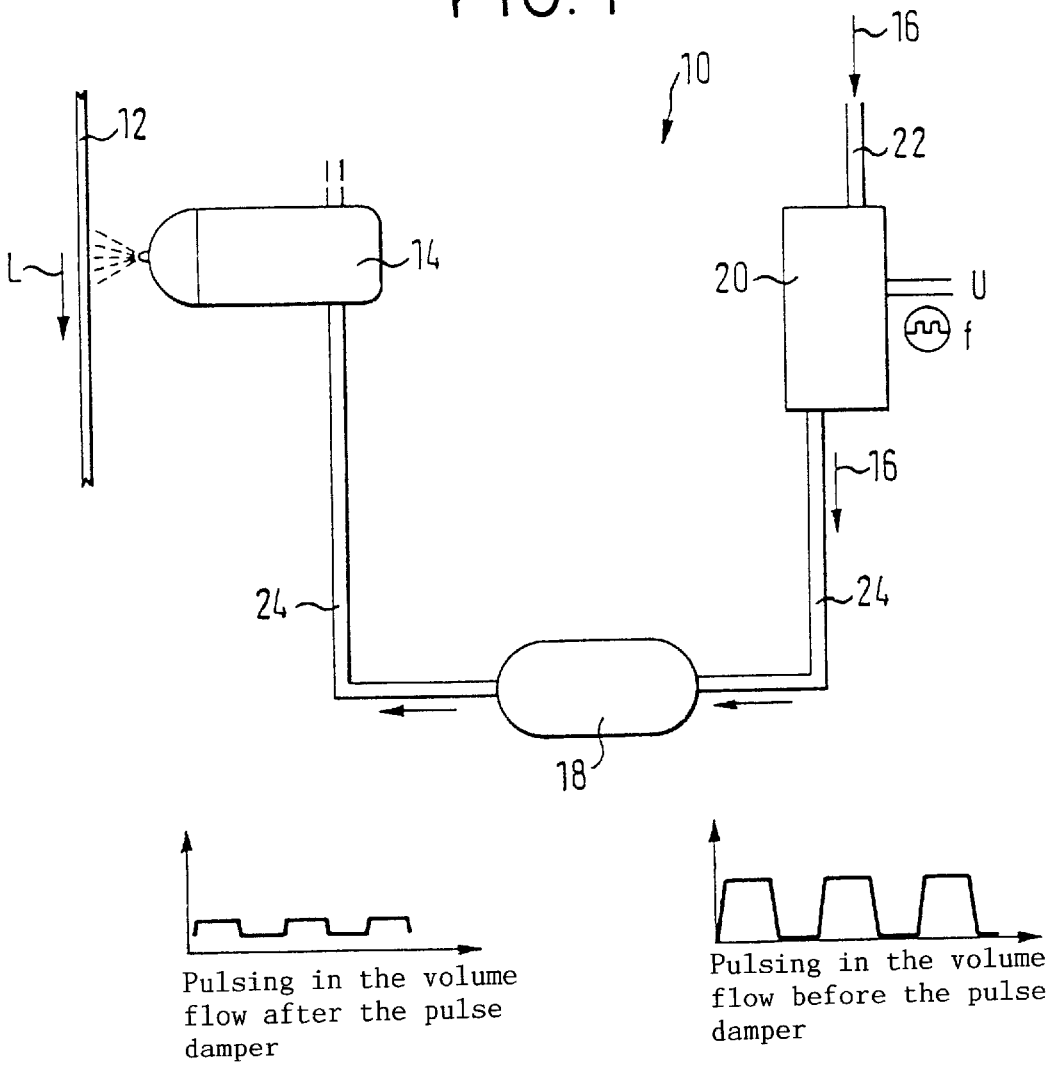
FIG. 1 a schematic partial representation of a possible embodiment of a device for spray treating a fibrous web.

FIG. 1 depicts a schematic partial representation of a possible embodiment of a device 10 for spraying a moving fibrous web 12. The fibrous web 12 can be, in particular, a paper or a cardboard web. The device 10 includes at least one jet 14 that is supplied with a preferably controlled volume flow of the relevant spray agent 16. The jet 14 is preceded by at least one pulse damper 18 in order to dampen the pulses contained in the volume flow of the spray agent 16.

The volume flow of the spray agent 16 is controlled by a pulsing valve 20. This can be, e.g., an armature valve and, in particular, a plate armature valve. This pulsing valve 20 is actuated via a control voltage U with a frequency f. Here, the volume flow can be varied, e.g., via pulse width modulation. In this case, the frequency f is preferably kept constant. As discernible from FIG. 1 the spray agent 16 is guided via a pipe 22 to the pulsing valve 20. The pulse damper 18 is positioned in a pipe 24 connecting the pulsing valve 20 with the jet 14. Therefore, it is between the pulsing valve 20 and the jet 14.

In the lower right side of FIG. 1 the pulsing of the volume flow in front of the pulse damper 18 is depicted. In reference to it, the pulsing of the volume flow behind the pulse damper is depicted in the lower left side of FIG. 1. Comparing the two pulse diagrams it is discernible that the pulsing contained in the volume flow of the spray agent 16 is damped by the pulse damper 18.

Figure 2:
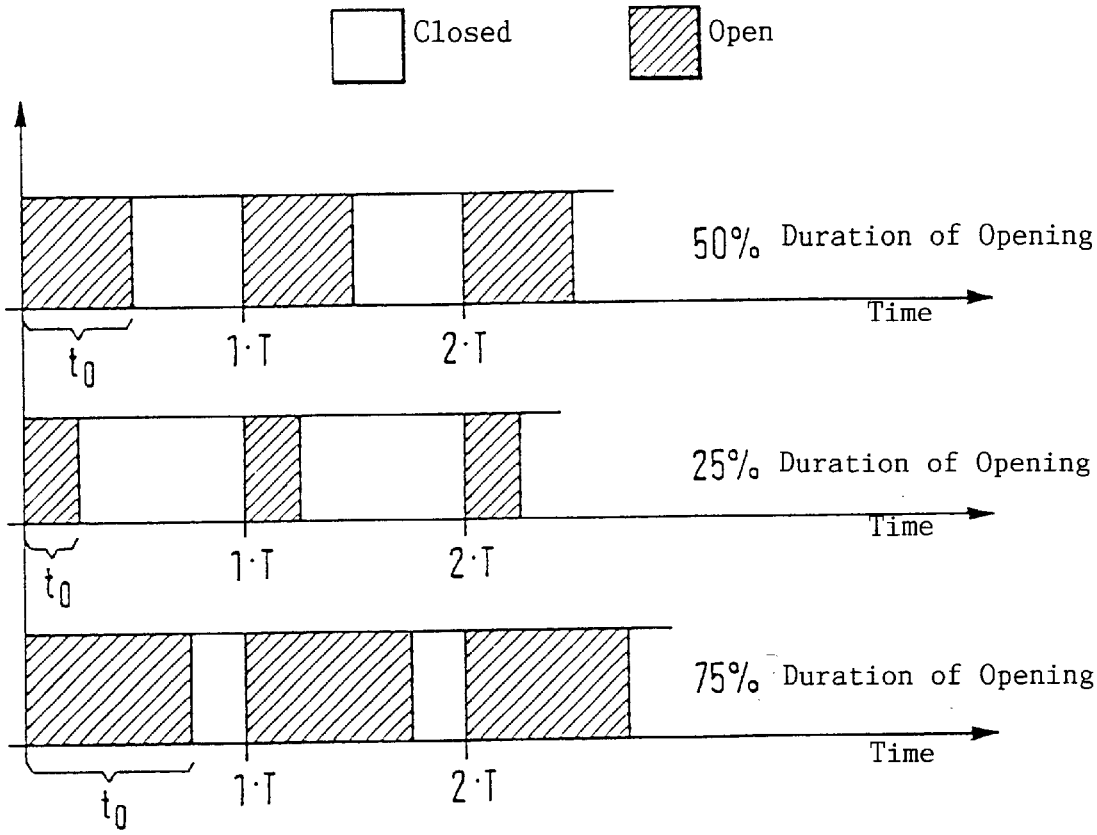
FIG. 2 an operational diagram explaining the operation of a pulsing valve.

FIG. 2 depicts an operational diagram for explaining the operation of the pulsing valve 20. During a generally constant interval of duration T, the pulsing valve opens and closes the flow once or it remains open continuously or is closed continuously. The duration of the opening interval $t_0$ can be varied. The ratio $t_0/T$ determines the opening duration of the pulsing valve. The longer the opening duration the more liquid can flow through the pulsing valve. Accordingly, the volume flow of the liquid can be controlled. The first time diagram results from an opening duration of about 50%, the second one from an opening duration of about 25%, and the third one from an opening duration of about 75%.

Figure 3:
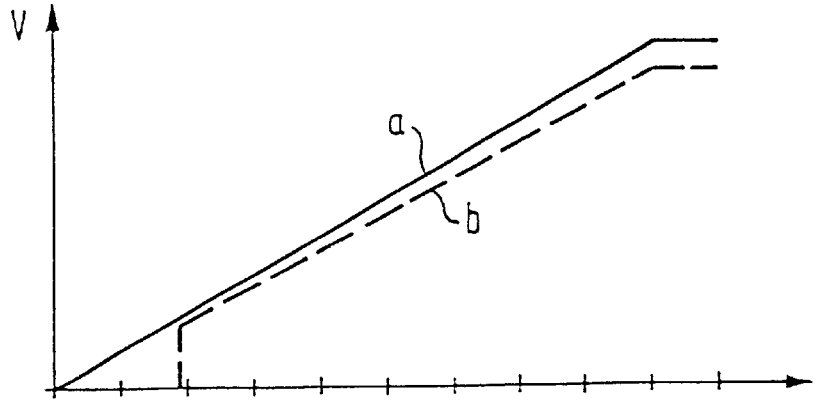
FIG. 3 an example of a characteristic curve of a pulsing valve with continuous volume flow control in relation to the equivalent characteristic curve of a proportional valve.

FIG. 3 depicts, e.g., a characteristic curve a of a pulsing valve in continuous volume flow control in relation to a corresponding characteristic curve b of a proportional valve. The unit depicted in FIG. 1, that includes the pulsing valve 20, the pulse damper 18, and the jet 14, can be used, in particular, in devices for spraying moving fibrous webs 12. Such spraying devices can include spray devices of paper and cardboard machines, and steam moisturizers, coating devices, starch spray devices, profiling devices, and/or the like. With the pulse damper 18 it is achieved that the pulses contained in the spray agent 16, that are created in particular by a pulsing valve 20, are damped.

Thus variations in the spray amount on the moving fibrous web can be reduced. Instead of a pulse damper, or additionally, e.g., a flexible inlet line to the jet can be provided. Additionally, it is possible, e.g., to use a pulsing valve 20 in combination with a jet having a large spray width or spray depth measured in the web travel direction L. Here, for instance, a unit containing a pulsing valve or a jet with a large spray width measured in web the travel direction or a unit containing a pulsing valve, a pulse damper (and/or a flexible inlet line), and a jet with a large spray width measured in the web travel direction can be provided.

Figure 4:
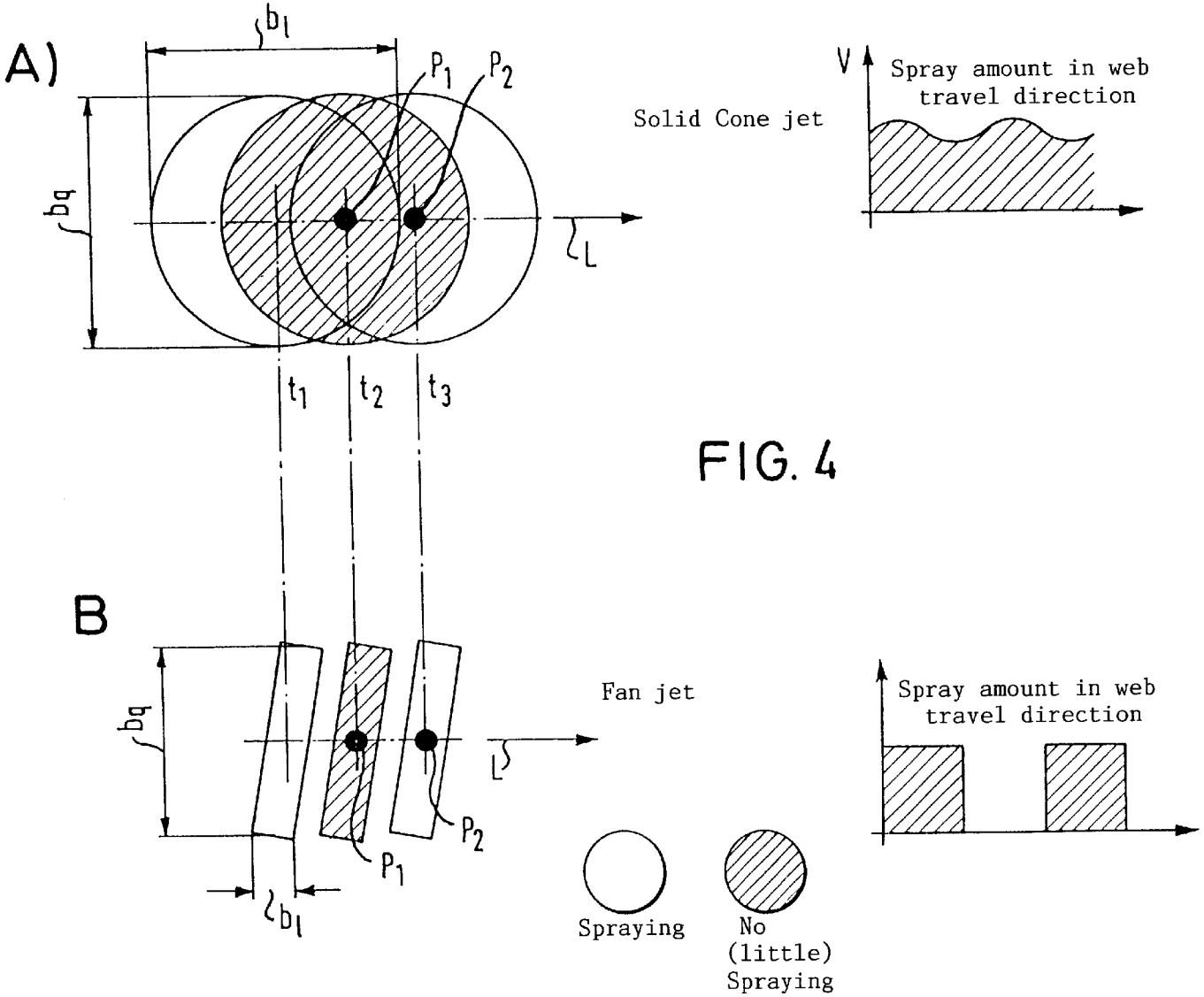
FIG. 4 compares the spray pattern of (A) a solid cone jet with a large spray width, measured in the web travel direction, to the spray pattern of a (B) fan jet.

FIG. 4 depicts the spray pattern a of such a jet 14 with a large spray width $b_l$ measured in the web travel direction L, here, e.g., a solid cone jet, as compared to the spray pattern B of a fan jet. Parts A and B of FIG. 4 depict the spray pattern of the relevant jet at the times $t_1$, $t_2$, and $t_3$. The shifting of the relevant spray pattern correlates to the moving web. The hatched area of each spray pattern shows that at that time the jet did not spray or sprayed only little. In contrast, the jet sprays in the unhatched area of the relevant spray pattern. The time progression of the pulses is represented in this way.

The spray pattern A results from a solid cone jet with a large spray width $b_l$ measured in the web travel direction. The points P1 and P2 are overlapped by a spray pattern with sprays and a spray pattern without sprays. This leads to a homogeneous spray pattern in the points P1 and P2 (compare the right part of FIG. 4A), regardless of the pulses contained in the volume flow of the spray agent.

The spray pattern B results from a fan jet with a small spray width $b_l$ measured in the web travel direction L. The points P1 and P2 are each overlapped only by a spray pattern with sprays or a spray pattern without sprays. This leads to a complete transmission of the pulses contained in the volume flow of the spray agent onto the spray pattern of web 12 (compare the right part of FIG. 4B).

Large spray widths $b_l$ measured in the web travel direction L lead, therefore, to a homogenizing of the pulses contained in the volume flow of the spray agent during spraying of the jet, as is shown in a comparison of the two diagrams on the right side of FIGS. 4A and 4B, in which the spray amount is depicted over the length of the web in each case. Instead of a solid cone jet, e.g., an elliptical fan jet can also be used as the jet with a large spray width $b_l$ measured in the web travel direction.

Therefore, a pulsing contained in the volume flow is reduced in the spray pattern by a large spray width $b_l$ measured in the web travel direction which is caused by the fact that the moisturizing of each point on the moving web occurs by the large spray width over a longer period of time. Thus, during this time period variations in the volume flow are leveled at the corresponding point. The spray width $b_l$ measured in the web travel direction of the corresponding jet can, e.g., be larger than about 30% of the spray width $b_q$ measured in the web travel direction.

Figure 5:
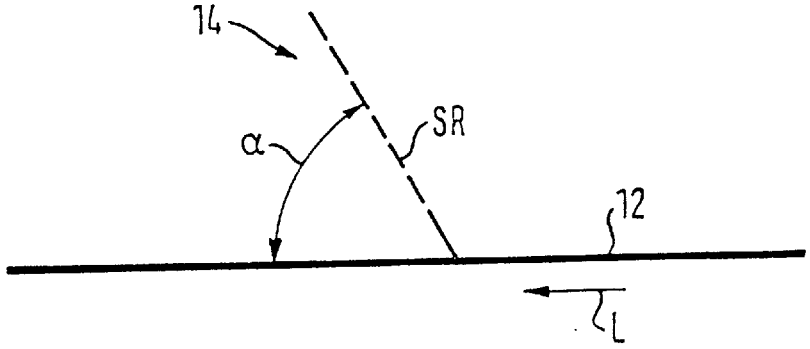
FIG. 5 an exemplary use of a fan jet spraying opposite the web travel direction at an angle.

As it results from FIG. 5 the jet 14 can, e.g., be used as a fan jet which sprays opposite the web travel direction L at an angle $\alpha$ to the fibrous web 12. In FIG. 5 the corresponding stream direction is named SR. The angle $\alpha$ can, in particular, be smaller than about 80° and, preferably, smaller than about 70°.

A unit comprised of a pulsing valve and a jet with a large spray width measured in the web travel direction can be used as well as a unit comprised of a pulsing valve, pulse damper (and/or a flexible inlet line) and a jet with a large spray width measured in web travel direction. In both units, e.g., an armature valve such as, in particular, a plate armature valve can be used. Both units can, e.g., be used for spraying moving fibrous webs, in particular, in spraying devices in paper and cardboard machines, in particular, in jet moisturizers, coating devices, starch spray devices, profiling devices and/or the like. In both units an elliptical fan jet or a solid cone jet can be used, e.g., as a jet with a large spray width $b_l$ measured in the web travel direction.

Moisture variations by the spraying onto the moving web are largely avoided with a unit comprised of a pulsing valve, a pulse damper (and/or a flexible inlet line) and a jet with a large spray width $b_l$ measured in the web travel direction, so that such units can be used in particular also with fast moving webs.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Characters

10 Spraying device
12 Fibrous web
14 Jet
16 Spray agent
18 Pulse damper
20 Valve
22 Pipe
24 Pipe
L Web travel direction
SR Stream direction
$b_l$ Spray width measured in web travel direction
$b_q$ Spray width measured lateral to the web travel direction
$\alpha$ Angle

What is claimed is:

1. A process for spraying a moving fibrous web with at least one jet, the process comprising:

feeding a controlled volume flow of a spray agent to the at least one jet through at least one pulsing valve; and damping and reducing pulses occurring in the controlled volume flow of the spray agent.

2. The process according to claim 1, wherein the fibrous web is one of paper and cardboard.

3. The process according to claim 1, further comprising controlling the controlled volume flow to the at least jet with the at least one pulsing valve.

4. The process according to claim 1, wherein the at least one pulsing valve comprises at least one armature valve.

5. The process according to claim 4, wherein the at least one pulsing valve comprises at least one plate armature valve.

6. The process according to claim 1, wherein the pulses occurring in the volume flow of the spray agent are damped or reduced by at least one of: (a) at least one pulse damping member preceding the at least one jet, (b) at least one jet having an appropriately large spray width measured in the web travel direction, and (c) at least one flexible inlet line provided to the at least one jet.

7. The process according to claim 1, wherein the at least one jet has a spray width measured in the web travel direction which is at least about 30% of the spray width measured lateral to the web travel direction.

8. The process according to claim 7, wherein the spray width measured in web travel direction is at least about 50% of the spray width measured lateral to the web travel direction.

9. The process according to claim 1, wherein the at least one jet comprises at least one elliptical fan jet.

10. The process according to claim 1, the at least one jet comprises at least one fan jet oriented to spray at an angle to the fibrous web smaller than about 80° and oriented opposite the web travel direction.

11. The process according to claim 10, wherein the angle is smaller than about 70°.

12. The process according to claim 11, wherein an appropriately rated fan jet is used at web speeds greater than 1200 m/min.

13. The process according to claim 12, wherein an appropriately rated fan jet is used at web speeds greater than 1500 m/min.

14. The process according to claim 1, wherein the at least one jet comprises at least one solid cone jet.

15. The process according to claim 1, wherein the controlled volume flow fed through the at least one pulsing valve is controlled by pulse width modulation.

16. The process according to claim 15, wherein the at least one pulsing valve is actuated with a constant frequency.

17. The process according to claim 1, wherein the process is used in one of paper and cardboard machines.

18. The process according to claim 1, wherein the process is used in at least one of jet moisturizers, coating devices, starch spray devices, and profiling devices.

19. An apparatus for spraying a moving fibrous web comprising:

at least one jet arranged to be fed with a controlled volume flow of a spray agent;

at least one pulsing valve which feeds the controlled volume flow of the spray agent to said at least one jet; and at least one pulse damper arranged to damp or reduce pulses occurring in the controlled volume flow of the spray agent.

20. The apparatus according to claim 19, wherein the fibrous web is one of a paper and cardboard web.

21. The apparatus according to claim 19, wherein said at least one pulsing valve is arranged to control the controlled volume flow fed to said at least one jet.

22. The apparatus according to claim 19, wherein said at least one pulsing valve comprises at least one armature valve.

23. The apparatus according to claims 19, wherein said at least one pulsing valve comprises at least one plate armature valve.

24. The apparatus according to claim 19, wherein said at least one pulse damper comprises at least one of (a) at least one pulse damping member positioned to precede said at least one jet, (b) an appropriately large spray width of said at least one jet measured in the web travel direction, and (c) at least one flexible inlet line coupled to said at least one jet.

25. The apparatus according to claim 24, wherein said at least one flexible inlet line provided to the jet is formed by a hose comprising one of polyethylene, polyurethane, and polyamide hose.

26. The apparatus according to claim 24, wherein said at least one flexible inlet line provided to said at least one jet has a length that is longer than about 3 m.

27. The apparatus according to claim 26, wherein the length of said at least one flexible inlet line is longer than about 5 m.

28. The apparatus according to claim 27, wherein said at least one pulsing valve and said at least one pulse damper are arranged in a common unit.

29. The apparatus according to claim 28, wherein said unit further comprises said at least one flexible inlet line and said at least one jet.

30. The apparatus according to claim 19, wherein said at least one jet is provided with a spray width measured in the web travel direction that is at least about 30% of the spray width measured lateral to the web travel direction.

31. The apparatus according to claim 30, wherein the spray width measured in the web travel direction is at least about 50% of the spray width measured lateral to the web travel direction.

32. The apparatus according to claim 19, wherein said at least one jet comprises at least one elliptical fan jet.

33. The apparatus according to claim 19, wherein said at least one jet comprises at least one fan jet which sprays at an angle to the fibrous web smaller than about 80° and opposite the web travel direction.

34. The apparatus according to claim 33, wherein the angle is smaller than about 70°.

35. The apparatus according to one of the claim 19, wherein said at least one jet comprises a solid cone jet.

36. The apparatus according to claim 19, wherein the volume flow fed via said at least one pulsing valve is controlled via pulse width modulation.

37. The apparatus according to claim 36, wherein said at least one pulsing valve is actuated with constant frequency.

38. The apparatus according to claim 19, which is utilized in one of paper and cardboard machines.

39. The apparatus according to claim 19, which is utilized in at least one of jet moisturizers, coating devices, starch spray devices, and profiling devices.

40. A process for spraying a moving fibrous web with at least one jet, the process comprising:

feeding a controlled volume flow of a spray agent to the at least one jet through at least one actively controlled pulsing valve; and damping and reducing pulses occurring in the controlled volume flow of the spray agent.

41. An apparatus for spraying a moving fibrous web comprising:

at least one jet arranged to be fed with a controlled volume flow of a spray agent;

at least one actively controlled pulsing valve which feeds the controlled volume flow of the spray agent to said at least one jet; and at least one pulse damper arranged to damp or reduce pulses occurring in the controlled volume flow of the spray agent.

* * * * *